US010441059B1

(12) United States Patent
Catlin

(10) Patent No.: US 10,441,059 B1
(45) Date of Patent: Oct. 15, 2019

(54) HAIR TREATMENT CAPE

(71) Applicant: Rhonda Catlin, New Market, VA (US)

(72) Inventor: Rhonda Catlin, New Market, VA (US)

( * ) Notice: Subject to any disclaimer, the term of this patent is extended or adjusted under 35 U.S.C. 154(b) by 77 days.

(21) Appl. No.: 15/838,808

(22) Filed: Dec. 12, 2017

(51) Int. Cl.
*A45D 44/08* (2006.01)
*A41D 3/08* (2006.01)

(52) U.S. Cl.
CPC ..... *A45D 44/08* (2013.01); *A41D 3/08* (2013.01)

(58) Field of Classification Search
CPC ..... A41D 3/08; A45D 44/08
USPC ..... 2/88, 50–52
See application file for complete search history.

(56) References Cited

U.S. PATENT DOCUMENTS 1,251,127 A * 12/1917 Spier ..... A45D 44/08 2/50
1,660,124 A * 2/1928 Grom ..... A45D 44/08 2/50
1,974,237 A * 9/1934 Eidinger ..... A41D 3/08 2/50
2,116,685 A 5/1938 Virginia
2,364,568 A * 12/1944 Tiscornia ..... A45D 44/08 2/49.2
2,523,565 A * 9/1950 Gardner ..... A41B 13/10 2/49.1
4,606,358 A 8/1986 Higgins
5,572,740 A 11/1996 Geniesse
6,934,968 B2 8/2005 Kurpis
D595,031 S 6/2009 Buono
7,836,518 B2 * 11/2010 Bloom ..... A41B 13/10 2/48
2007/0074329 A1 * 4/2007 Marshall ..... A41D 3/08 2/69
2013/0152271 A1 * 6/2013 Clark ..... A41D 1/21 2/104
2015/0059043 A1 * 3/2015 Dwyer ..... A41D 13/081 2/20
2017/0007007 A1 * 1/2017 Miyamoto ..... A45D 44/08

FOREIGN PATENT DOCUMENTS

DE 3404358 A 3/1985

* cited by examiner

*Primary Examiner* — Gloria M Hale

(57) ABSTRACT

The hair treatment cape is a protective garment. The hair treatment cape is a cloak that is donned during hairdressing activities. Specifically, the hair treatment cape is worn during chemical treatments such a permanents and hair dyeing. The hair treatment cape comprises a cape, an overlay, and a collar. The overlay attaches to the cape. The collar attaches to the overlay. The cape is a sheeting that forms a liquid impermeable barrier that protects the user from participation in inadvertent chemical processes. The overlay rests on top of the cape. The overlay absorbs liquid spilled from chemical treatments before the spilled liquid reaches the cape. The collar: 1) is a diverting structure that routes spilled liquids towards the overlay; and, 2) secures the hair treatment cape to the neck of a user.

11 Claims, 5 Drawing Sheets

HAIR TREATMENT CAPE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles, more specifically, a protective shoulder shield configured for use in hairdressing.

SUMMARY OF INVENTION

The hair treatment cape is a protective garment. The hair treatment cape is a cloak that is donned during hairdressing activities. Specifically, the hair treatment cape is worn during chemical treatments such as permanents and hair dyeing. The hair treatment cape comprises a cape, an overlay, and a collar. The overlay attaches to the cape. The collar attaches to the overlay. The cape is a sheeting that forms a liquid impermeable barrier that protects the user from participation in inadvertent chemical processes. The overlay rests on top of the cape. The overlay absorbs liquid spilled from chemical treatments before the spilled liquid reaches the cape. The collar: 1) is a diverting structure that routes spilled liquid towards the overlay; and, 2) secures the hair treatment cape to the neck of a user.

These together with additional objects, features and advantages of the hair treatment cape will be readily apparent to those of ordinary skill in the art upon reading the following detailed description of the presently preferred, but nonetheless illustrative, embodiments when taken in conjunction with the accompanying drawings.

In this respect, before explaining the current embodiments of the hair treatment cape in detail, it is to be understood that the hair treatment cape is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hair treatment cape.

It is therefore important that the claims be regarded as including such equivalent construction insofar as they do not depart from the spirit and scope of the hair treatment cape. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
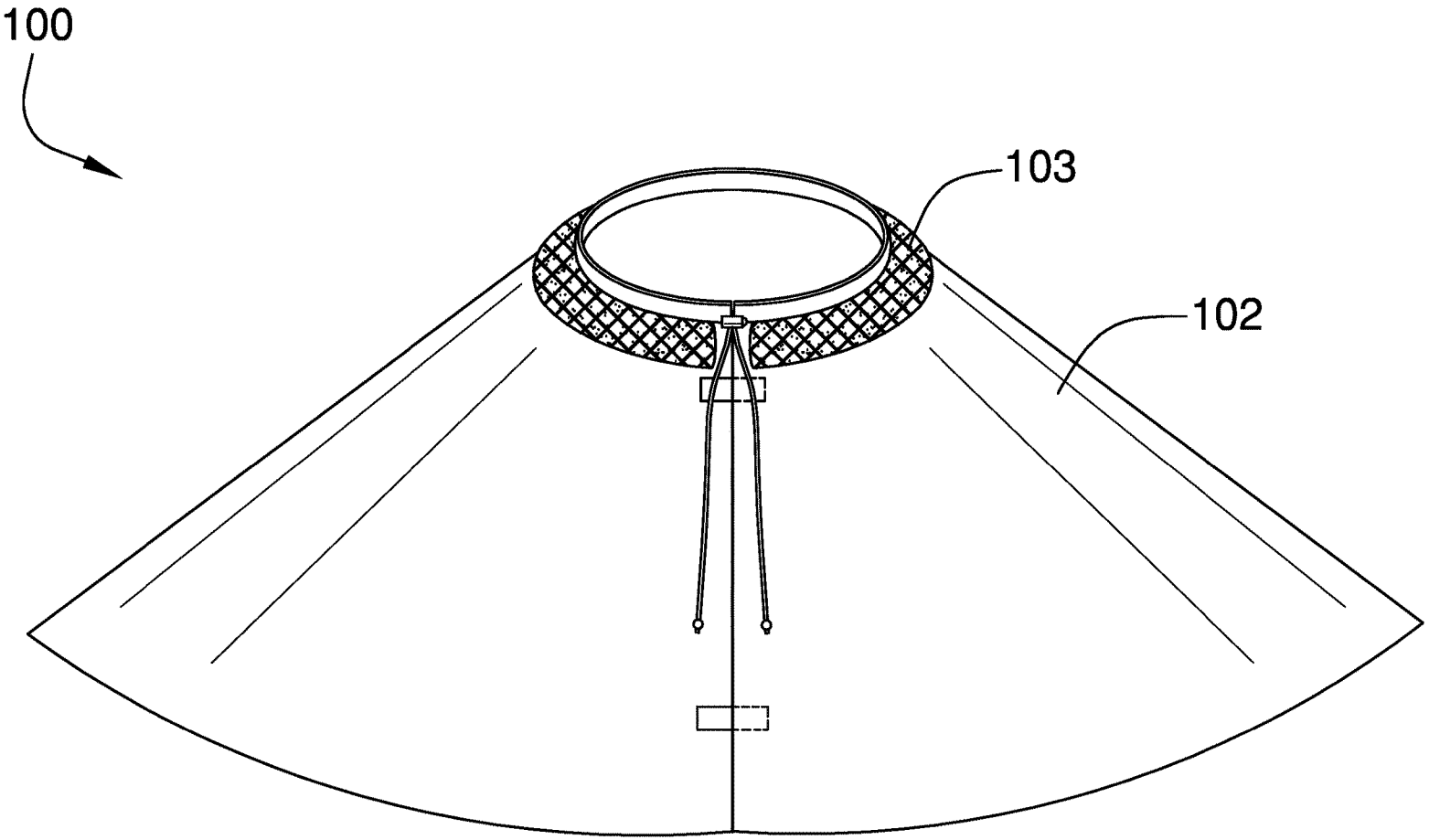
FIG. 1 is a perspective view of an embodiment of the disclosure.
Figure 2:
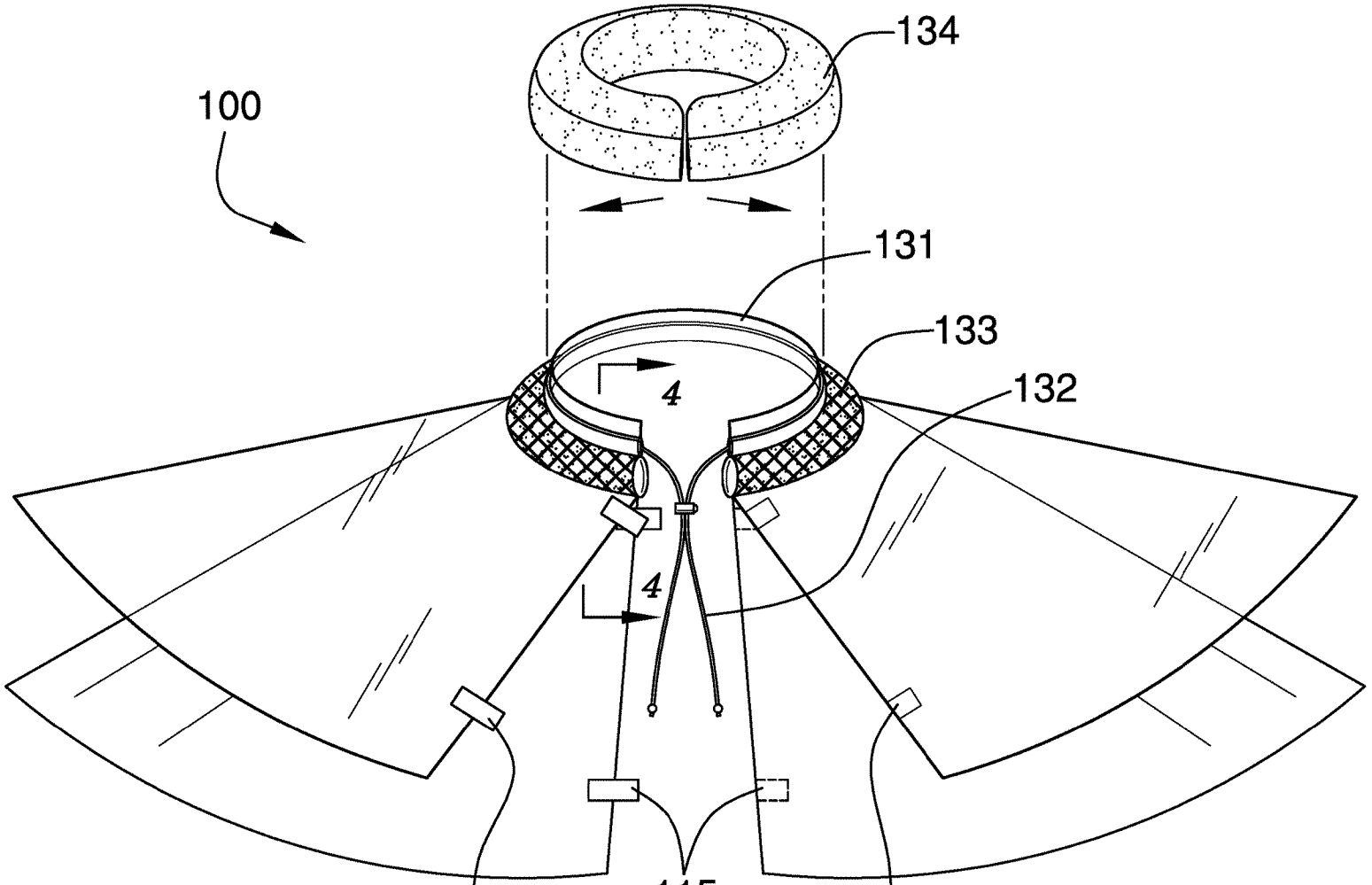
FIG. 2 is an exploded perspective view of an embodiment of the disclosure.
Figure 3:
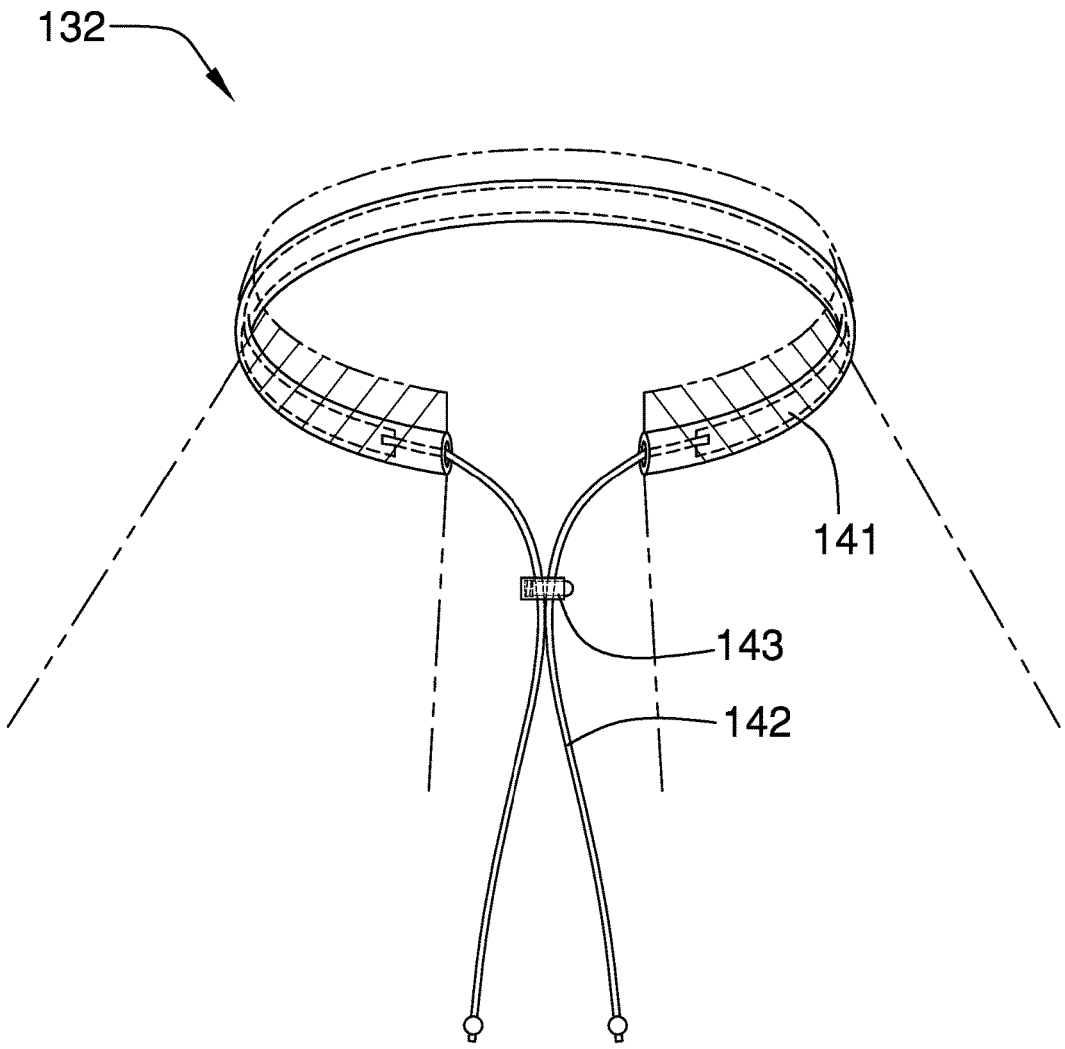
FIG. 3 is a detail view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The hair treatment cape 100 (hereinafter invention) is a protective garment. The invention 100 is a cloak that is donned during hairdressing activities. Specifically, the invention 100 is worn during chemical treatments such a permanents and hair dyeing. The invention 100 comprises a cape 101, an overlay 102, and a collar 103. The overlay 102 attaches to the cape 101. The collar 103 attaches to the overlay 102. The cape 101 is a sheeting that forms a liquid 153 impermeable barrier that protects the user 151 from participation in inadvertent chemical processes. The overlay 102 rests on top of the cape 101. The overlay 102 absorbs liquid 153 spilled from chemical treatments before the spilled liquid 153 reaches the cape 101. The collar 103: 1) is a diverting structure that routes the spilled liquid 153 towards the overlay 102; and, 2) secures the invention 100 to the neck 152 of a user 151.

The cape 101 is a sheeting that is worn around the neck 152 of the user 151. The cape 101 forms a liquid 153 impermeable barrier that protects the user 151 from liquid 153 spills during the hairdressing process. The cape 101 is cut in a circular shape such that the cape 101 will drape over the user 151. The cape 101 comprises a cape sheeting 111, a cape aperture 112, a cape inner diameter 113, and a cape vent 114.

The cape sheeting 111 is a sheeting formed from a liquid impermeable material. In the first potential embodiment of the disclosure, the cape sheeting 111 is formed from a waterproof sheeting. The cape sheeting 111 is cut in a circular shape. The cape sheeting 111 is further defined with a cape diameter 116.

The cape aperture 112 is a circular hole cut in the center of the cape sheeting 111. The cape sheeting 111 and the cape aperture 112 form concentric circles. The cape aperture 112 is sized such that the neck 152 of the user 151 will fit through the cape aperture 112 while the invention 100 is worn. The cape aperture 112 is further defined with a cape inner diameter 113.

The cape vent 114 is a radial cut in the cape sheeting 111 that is formed from the circumference of the cape aperture 112 to, and through, the circumference of the cape sheeting 111. The purpose of the cape vent 114 is to allow the cape 101 to be wrapped around the neck 152 of the user 151.

The cape fastener 115 is a commercially available fastener that closes the cape vent 114 such that the user 151 is securely enclosed within the cape 101. In the first potential embodiment of the disclosure, the cape fastener 115 is a commercially available hook and loop fastener. The hook and loop fastener is discussed in greater detail elsewhere in this disclosure.

The overlay 102 is a sheeting that is laid over the cape 101 such that the cape 101 is positioned between the overlay 102 and the user 151. The overlay 102 is commonly referred to as a sham. The overlay 102 is formed from an absorbent material. The purpose of the overlay 102 is to absorb liquid 153 spilled during the hairdressing process. By absorbing the spilled liquid 153, the overlay 102 can store the spilled liquid 153 until the spilled liquid 153 can be disposed of. Should the overlay 102 become saturated, the excess liquid escapes the overlay 102 directly on to the cape 101. From the overlay 102, the cape 101 will route the spilled liquid 153 away from the user 151 to the floor. The overlay 102 is cut in a circular shape such that the overlay 102 will drape over the cape 101. The overlay 102 comprises an overlay sheeting 121, an overlay aperture 122, an overlay inner diameter 123, and an overlay vent 124.

The overlay sheeting 121 is a sheeting formed from an absorbent material. In the first potential embodiment of the disclosure, the overlay sheeting 121 is formed from a chamois type material. The overlay sheeting 121 is cut in a circular shape. The overlay sheeting 121 is further defined with an overlay diameter 126.

The overlay aperture 122 is a circular hole that is cut in the center of the overlay sheeting 121. The overlay sheeting 121 and the overlay aperture 122 form concentric circles. The overlay aperture 122 is sized such that the neck 152 of the user 151 will fit through the overlay aperture 122 while the invention 100 is worn. The overlay aperture 122 is further defined with an overlay inner diameter 123.

The overlay vent 124 is a radial cut in the overlay sheeting 121 that is formed from the circumference of the overlay aperture 122 to, and through, the circumference of the overlay sheeting 121. The purpose of the overlay vent 124 is to allow the cape sheeting 111 to be wrapped around the neck 152 of the user 151.

The overlay fastener 125 is a commercially available fastener that closes the overlay vent 124 such that the cape 101 is fully covered by the overlay 102. In the first potential embodiment of the disclosure, the overlay fastener 125 is a commercially available hook and loop fastener. The hook and loop fastener is discussed in greater detail elsewhere in this disclosure.

The cape inner diameter 113 of the cape sheeting 111 is identical to the overlay inner diameter 123 of the overlay sheeting 121. The cape diameter 116 of the cape sheeting 111 is greater than the overlay diameter 126 of the overlay sheeting 121.

Figure 4:
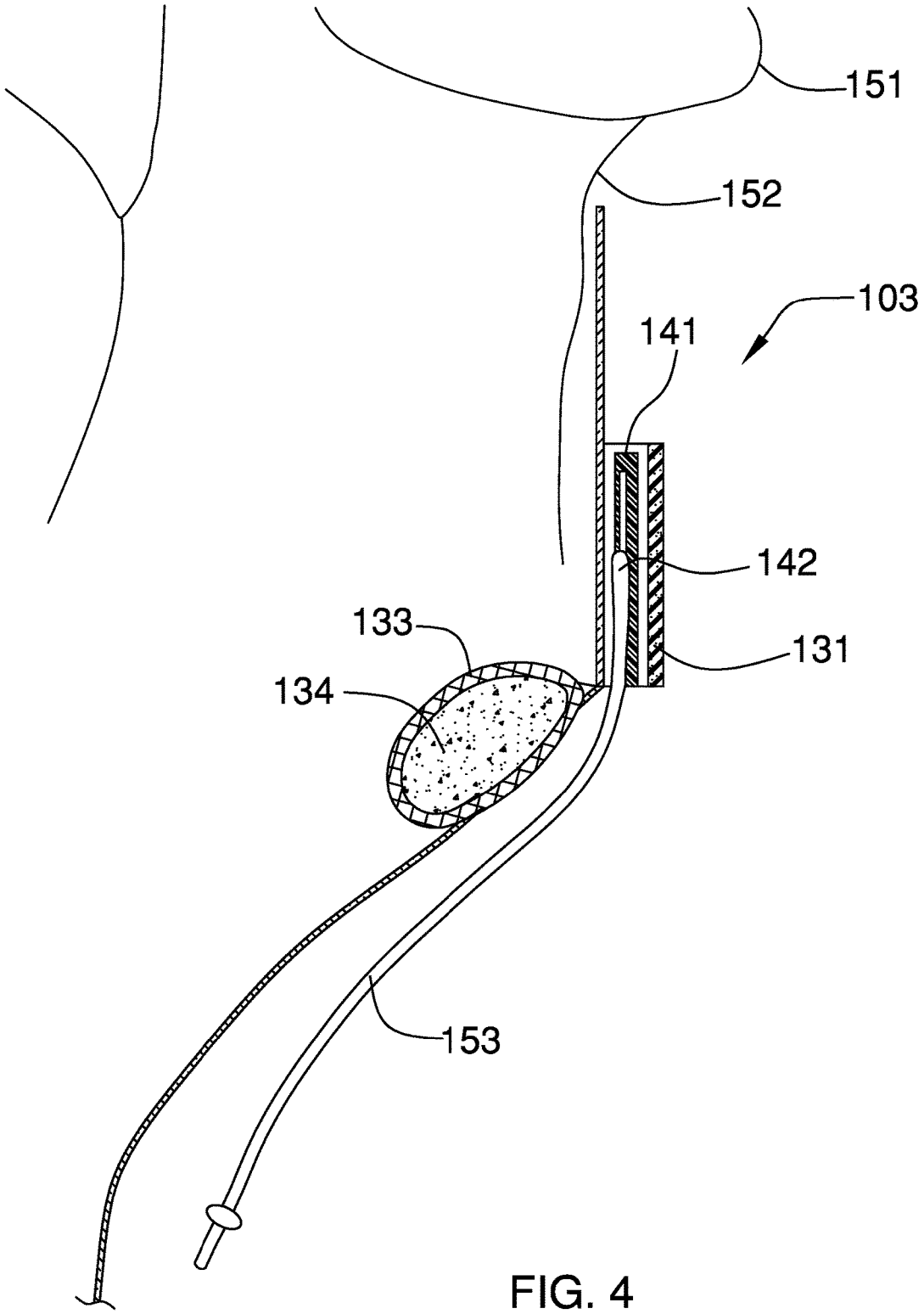
FIG. 4 is a cross-sectional view of an embodiment of the disclosure across 4-4 as shown in FIG. 2.
Figure 5:
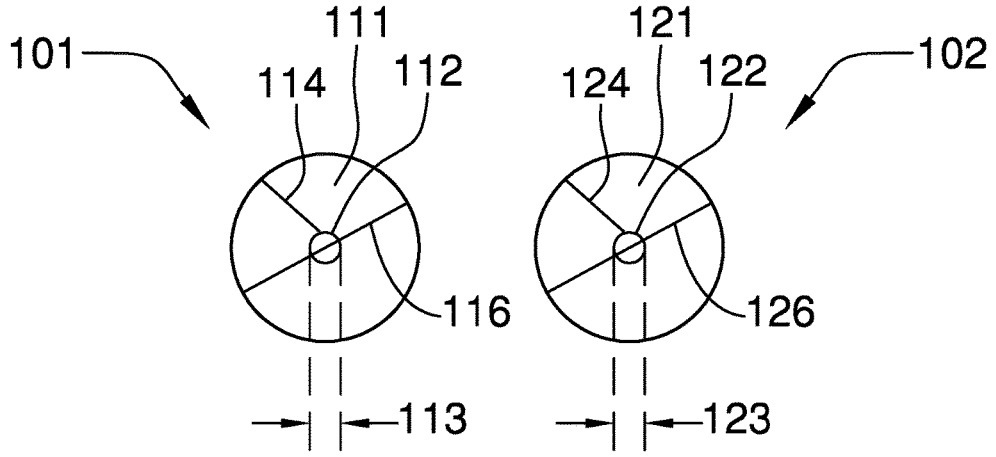
FIG. 5 is a detail view of an embodiment of the disclosure.

As shown most clearly in FIG. 4, a removable seam 127 attaches to the cape aperture 112 to the overlay sheeting 121 such that the overlay aperture 122 and the cape aperture 112 are aligned.

The collar 103 is a mechanical structure. The collar 103 attaches the cape 101 and the overlay 102 around the neck 152 of the user 151. The collar 103 forms a liquid 153 impermeable barrier that isolates the neck 152 of the user 151 from the waterproof guard 131. The collar 103 comprises a waterproof guard 131, a drawstring 132, a mesh covered channel sponge 133, and a detachable sponge 134.

The waterproof guard 131 is a flexible waterproof strip that can be formed into a loop. The waterproof guard 131 is rectangular in shape. The waterproof guard 131 is looped around the neck 152 of the user 151. The waterproof guard 131 combines with the overlay sheeting 121 to form a liquid 153 impermeable barrier that: 1) routes the liquid 153 away from the neck 152 towards the overlay 102; and, 2) prevents liquid 153 from coming in contact with the user 151. The waterproof guard 131 attaches to the overlay sheeting 121 using an adhesive. In the first potential embodiment of the disclosure, the interior surface of the waterproof guard 131 is lined with a rubber strip.

The drawstring 132 is a well-known and documented device that secures the waterproof guard 131 to the neck 152 of the user 151. In the first potential embodiment of the disclosure, the drawstring 132 is a commercially available device commonly referred to as quick cord. The drawstring 132 comprises a channel 141, a cord 142, and a cord lock 143.

The channel 141 is a textile channel that is used to contain the drawstring 132. The channel 141 attaches to the waterproof guard 131 in the manner of a rouleau. The cord 142 is a commercially available cord threaded through the channel 141. The channel 141 holds the cord 142 in position. The cord 142 tightens the waterproof guard 131 around the neck 152 of the user 151 while the invention 100 is in use. The cord lock 143 is a commercially available spring-loaded fastening device that locks the cord 142 and, by implication, the waterproof guard 131 in position during use of the invention 100. In the first potential embodiment of the disclosure, the channel 141 and the cord 142, are provisioned through the quick cord. The quick cord attaches to the waterproof guard 131.

The drawstring 132 is discussed in additional detail elsewhere in this disclosure.

The mesh covered channel sponge 133 is an absorbent tubular textile covered with a mesh textile. The mesh covered channel sponge 133 attaches to the exterior surface of the waterproof guard 131. The purpose of the mesh covered channel sponge 133 is to absorb spilled liquid 153 near the neck 152 of the user 151.

The detachable sponge 134 is a flexible rounded ring structure. The detachable sponge 134 is formed from a porous absorbent material. The detachable sponge 134 is formed from an elastic material. The circumference of the detachable sponge 134 is bifurcated with a cut such that the ends of the cut surface can be separated to put the detachable sponge around the neck 152 of the user 151. The detacable sponge 134 is placed around the exterior surface of the collar 103 during normal use of the invention 100. The purpose of the detachable sponge 134 is to absorb spilled liquid 153 near the neck 152 of the user 151. The The following definitions were used in this disclosure:

Absorbent: As used in this disclosure, absorbent is an adjective that refers to a material that can soak up a liquid such as water.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cape: As used in this disclosure, a cape is a sleeveless garment that hangs from the shoulder and is used as outerwear. A cape may or may not have a hood.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Channel: As used in this disclosure, a channel is a tubular passage through which an object or fluid is passed through.

Coaxial: As used in this disclosure, coaxial is a term that refers to a first object that is inserted or contained within a second object such: 1) that the first object and the second object share the same center point if the first object and the second object are treated as a two dimensional objects; or, 2) that the first object and the second object share the same center axis if the first object and the second object are treated as a prism.

Cord: As used in this disclosure, a cord is a long, thin, and flexible piece of string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord. See strand or wire Cord Lock: As used in this disclosure, a cord lock is a device that is used to tighten cords or drawstrings without the use of knots.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Don: As used in this disclosure, to don means to put a garment on a person.

Drape: As used in this disclosure, to drape means to arrange fabric in flowing lines and folds.

Drawstring: As used in this disclosure, a drawstring is a cord, tape, or a webbing that is contained within a channel that is used to fasten or cinch a textile based object such as an item of apparel of a textile covering. Generally, the channel and cord are formed as a single textile component (in the form of a tape that is often marketed commercially "Quick Cord") that is sewn as a single unit into the textile based object after which the cord is released within the channel.

Fastener: As used in this disclosure, a fastener is a device that is used to join or affix two objects. Fasteners generally comprise a first element, which is attached to the first object and a second element which is attached to the second object such that the first element and the second element join to affix the first object and the second object. Common fasteners include, but are not limited to, hooks, zippers, snaps, buttons, buckles, quick release buckles, or hook and loop fasteners.

Fluid: As used in this disclosure, a fluid refers to a state of matter wherein the matter is capable of flow and takes the shape of a container it is placed within. The term fluid commonly refers to a liquid or a gas.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Liquid: As used in this disclosure, a liquid refers to a state of matter that is fluid and that maintains, for a given pressure, a fixed volume that is independent of the volume of the container.

Loop: As used in this disclosure, a loop is the length of a first linear structure including, but not limited to, shafts, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Nap: As used in this disclosure, a nap refers to one or more loose yarns that are incorporated in a textile such that the separated, or "raised," from the plane of the primary surface of a textile. A nap may: 1) take the form of a loop; or 2) take the form of loose "ends" extending beyond the textile. Within this disclosure, the terms pile and nap are synonyms.

Perimeter: As used in this disclosure, a perimeter is one or more curved or straight lines that bounds an enclosed area on a plane or surface. The perimeter of a circle is commonly referred to as a circumference.

Radial: As used in this disclosure, the term radial refers to a direction that: 1) is perpendicular to an identified central axis; or, 2) projects away from a center point.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Rectilinear Block: As used in this disclosure, a rectilinear block refers to a three-dimensional structure comprising a plurality of rectangular surfaces. Rectilinear blocks are similar to rectangular blocks and are often used to create a structure with a reduced interior volume relative to a rectangular block. Within this disclosure, a rectilinear block may further comprise rounded edges and corners.

Ring: As used in this disclosure, a ring is term that is used to describe a flat or plate like structure through which an aperture is formed.

Rouleau: As used in this disclosure, a rouleau is a tube or channel that is formed on the edge of a textile.

Rounded: A used in this disclosure, the term rounded refers to the replacement of an apex, vertex, or edge or brink of a structure with a (generally smooth) curvature wherein the concave portion of the curvature faces the interior or center of the structure.

Saturated: As used in this disclosure, saturated refers to: 1) an absorbent material that contains as much liquid as the absorbent material can absorb; or, 2) a solvent that contains as much of a solute as the solvent is capable of dissolving.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sheeting: As used in this disclosure, sheeting is a material, such as a textile, a waterproof, or a metal foil, in the form of a thin flexible layer or layers.

Sponge: As used in this disclosure, a sponge is a material, generally with a fibrous structure, that is capable of absorbing and retaining liquids.

Strip: As used in this disclosure, the term describes a long thin object of uniform width. Strips are often rectangular blocks in shape.

Chamois type material: As used in this disclosure, a chamois type material is a soft, pliable leather from any variety of skins dressed with oil, originally from the skin of the chamois. Synthetic chamois is a cotton cloth finished to simulate this leather.

Textile: As used in this disclosure, a textile is a material that is woven, knitted, braided or felted. Synonyms in common usage for this definition include fabric and cloth.

Tubular Textile: As used in this disclosure, a tubular textile is a textile that is woven, knitted, or braided into a seamless tube like shape.

Vent: As used in this disclosure, a vent is a cut formed in a fabric such that the cut goes through an edge of the fabric.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A shoulder shield comprising:

an overlay, and a collar;

wherein the overlay attaches to a cape;

wherein the collar attaches to the overlay;

wherein the shoulder shield is adapted to be worn by a user;

wherein the shoulder shield is configured for use during hairdressing activities wherein the cape forms a liquid impermeable barrier;

wherein the overlay absorbs a liquid spilled during hairdressing activities;

wherein the collar is adapted to secure the shoulder shield to a neck of said user;

wherein the cape is a sheeting that is cut in a circular shape;

wherein the overlay rests on top of the cape;

wherein the cape comprises a cape sheeting, a cape aperture, a cape vent, and a cape fastener;

wherein the cape aperture and the cape vent are formed in the cape sheeting;

wherein the cape fastener attaches to the cape sheeting;

wherein the cape aperture is further defined with a cape inner diameter;

wherein the cape sheeting is a sheeting;

wherein the cape sheeting is formed from a liquid impermeable material;

wherein the cape sheeting is cut in a circular shape;

wherein the cape sheeting is further defined with a cape diameter and a cape aperture;

wherein the cape aperture is a circular hole cut in the center of the cape sheeting;

wherein the cape sheeting and the cape aperture form concentric circles;

wherein the cape aperture is sized such that the neck of the user will fit through the cape aperture;

wherein the cape vent is a radial cut in the cape sheeting;

wherein the cape vent is formed from a circumference of the cape aperture to the circumference of the cape sheeting;

wherein the cape vent cuts through the circumference of the cape sheeting;

wherein the cape fastener closes the cape vent such that the user is enclosed within the cape;

wherein the overlay is a sheeting that is cut in a circular shape; and wherein the overlay is laid over the cape such that the cape is positioned between the overlay and the user.

2. The shoulder shield according to claim 1 wherein the overlay comprises an overlay sheeting, an overlay aperture, an overlay vent and an overlay fastener;

wherein the overlay aperture and the overlay vent are formed in the overlay aperture;

wherein the overlay fastener attaches to the overlay sheet;

wherein the overlay sheeting is further defined with an overlay diameter; and wherein the overlay aperture is further defined with an overlay inner diameter.

3. The shoulder shield according to claim 2 wherein the overlay aperture is a circular hole that is cut in a center of the overlay sheeting;

wherein the overlay sheeting and the overlay aperture form concentric circles; and wherein the overlay aperture is sized such that the neck of the user will fit through the overlay aperture.

4. The shoulder shield according to claim 3 wherein the overlay sheeting includes an overlay vent;

wherein the overlay vent is a radial cut in the overlay sheeting; and wherein the overlay vent cuts through the circumference of the overlay sheeting.

5. The shoulder shield according to claim 4 wherein the overlay fastener is a fastener that closes the overlay vent such that the cape is covered by the overlay.

6. The shoulder shield according to claim 5 wherein a cape inner diameter of the cape sheeting is identical to an overlay inner diameter of the overlay sheeting; and wherein a cape diameter of the cape sheeting is greater than the overlay diameter of the overlay sheeting.

7. The shoulder shield according to claim 6 wherein the collar comprises a waterproof guard, a drawstring, a mesh covered channel sponge, and a detachable sponge;

wherein the draw string and the mesh covered channel sponge attach to the waterproof guard; and wherein the detachable sponge attaches to an exterior surface of the collar.

8. The shoulder shield according to claim 7 wherein the waterproof guard is adapted to be looped around the neck of the user; and wherein the waterproof guard attaches to the overlay sheeting using an adhesive.

9. The shoulder shield according to claim 8 wherein the drawstring comprises a channel, a cord, and a cord lock;

wherein the channel is a textile channel that is used to contain the drawstring;

wherein the channel attaches to the waterproof guard;

wherein the cord is threaded through the channel;

wherein the cord tightens the waterproof guard around the neck of the user; and wherein the cord lock locks the cord and the waterproof guard in position;

wherein the drawstring attaches to the waterproof guard.

10. The shoulder shield according to claim 9 wherein the mesh covered channel sponge is an absorbent tubular textile formed from a mesh textile;

wherein the detachable sponge is a flexible rounded rectilinear block structure;

wherein the detachable sponge is formed from a porous absorbent material; and wherein the detachable sponge inserts into the mesh covered channel sponge.

11. The shoulder shield according to claim 10 wherein the cape sheeting is formed from a waterproof sheeting;

wherein the cape fastener is a first hook and loop fastener; and wherein the overlay fastener is a second hook and loop fastener.

* * * * *